United States Patent [19]

Metzler

[11] 4,391,190

[45] Jul. 5, 1983

[54] PRE-SETTING OF PRINTING MACHINES

[75] Inventor: Hans-Georg Metzler, Höchstadt, Fed. Rep. of Germany

[73] Assignee: Siemens Aktiengesellschaft, Munich, Fed. Rep. of Germany

[21] Appl. No.: 171,368

[22] Filed: Jul. 23, 1980

[30] Foreign Application Priority Data

Jul. 26, 1979 [DE] Fed. Rep. of Germany ..... 2930438

[51] Int. Cl.[3] ..... B41M 1/14; B41F 5/16; B65H 23/04

[52] U.S. Cl. ..... 101/211; 101/181; 226/27; 318/603

[58] Field of Search ..... 101/181, 211, 248, 227, 101/178, 426; 318/85, 603; 250/548; 235/475, 92 CP, 92 R, 92 V, 92 NT, 92 TF; 226/27, 45

[56] References Cited

U.S. PATENT DOCUMENTS

| | | | |
|---|---|---|---|
| 3,025,791 | 3/1962 | Auerbacher | 101/181 |
| 3,165,056 | 1/1965 | Heatley et al. | 101/181 |
| 3,218,969 | 11/1965 | Nagel | 101/181 |
| 3,653,322 | 4/1972 | Richardson | 101/181 |
| 3,896,377 | 7/1975 | Richardson | 101/181 |
| 3,963,902 | 6/1976 | Dowd | 235/92 EAX |
| 4,067,760 | 1/1978 | Nelson | 101/181 X |
| 4,070,965 | 1/1978 | Aenishaenslin et al. | 101/181 X |
| 4,129,238 | 12/1978 | Herd | 101/181 X |
| 4,147,104 | 4/1979 | Zernov et al. | 101/181 |
| 4,214,524 | 7/1980 | Corse | 101/181 |
| 4,243,925 | 1/1981 | Gnuechtel | 101/181 X |
| 4,366,753 | 1/1983 | Glanz et al. | 101/181 |

FOREIGN PATENT DOCUMENTS

| | | | |
|---|---|---|---|
| 23299 | 2/1981 | European Pat. Off. | 101/181 |
| 450528 | 4/1935 | United Kingdom | 226/27 |

OTHER PUBLICATIONS

"Intel Component Data Catalog" 1978 pp. 11—11-1-1—17.

*Primary Examiner*—Edgar S. Burr
*Assistant Examiner*—Moshe I. Cohen
*Attorney, Agent, or Firm*—Kenyon & Kenyon

[57] ABSTRACT

Disclosed are a method and apparatus for pre-setting the register in photogravure printing machines. According to the invention, the angular position of a first printing cylinder is determined relative to a scanning device when the cylinder adjusting mark passes the scanning device. The first cylinder is held stationary and its angular position is stored upon detection of the adjusting mark. An upstream cylinder is rotated and a pulse is generated when the angular position of the upstream cylinder is rotated past the stored angular position of the first cylinder. The web distance traveled between the generation of said pulse and the detection by the scanning device of the adjusting mark of the upstream cylinder is proportional to the angular offset of the two cylinders. A signal proportion to this web distance can be used as a register positioning command.

13 Claims, 9 Drawing Figures

PRE-SETTING OF PRINTING MACHINES

BACKGROUND OF THE INVENTION

The present invention relates to pre-setting of printing machines in general and to pre-setting the register in printing machines in particular, especially in photogravure printing machines.

In changing a photogravure printing machine for a new production run, a set-up time of about 20 minutes to one hour is normally required, with an additional 20 minutes being required before production is resumed. A waste of about 2 to 3000 meters of printing web or paper can be produced during the set-up process. In view of the capital costs of the machine, set-up time is relatively expensive. Moreover, the cost of the waste paper is not negligible. Therefore, it would be highly desirable to shorten the time required to resume full production between one production run and the next. The printing cylinders may be completely unbalanced after new printing cylinders are put in place and a not inconsiderable portion of the set-up time is spent in readjusting the register of the printing cylinders in such a manner that a control system can thereafter ensure registration. Heretofore, the individual adjustment elements were moved in accordance with a visual impression in such a manner that at least reasonably registered prints were obtained. This procedure naturally takes considerable time.

OBJECTS AND SUMMARY OF THE INVENTION

It is an object of the present invention to reduce set-up time in printing machines between production runs, particularly in photogravure printing machines.

It is another object of the present invention to measure the offset between printing cylinders of a printing machine.

It is also an object of the present invention to pre-set the register in a printing machine quickly.

It is another object of the present invention to pre-set the register of printing cylinders in a printing machine quickly.

It is a further object of the present invention to accomplish such pre-setting automatically.

According to the invention, the register between two printing stations is accomplished by activating a downstream printing station, deactivating an upstream printing station, and determining and storing the angular position of the printing cylinder of the upstream station when a registration (or adjusting or reference) mark or indication printed by that cylinder is detected by a scanning device. Then the downstream printing station is deactivated and the upstream printing station is activated. The distance traveled by the web or sheet between detection of rotation of the printing cylinder of the upstream printing station past an angular position thereof corresponding to said angular position of the printing cylinder of the downstream printing station and detection of the reference mark printed by the printing cylinder of the upstream printing station by the scanning device corresponds to the angular offset of the cylinders. A signal proportional to this web distance is used as a registration setting command. In this manner, setting commands are derived directly from the printing web, i.e., the working material itself, so that the pre-setting process is accelerated and can be achieved for the entire machine. The invention permits the printing cylinders to be placed in the machine in any angular position.

According to the invention, the format or the cylinder circumference and the web travel distance between two printing stations can be determined at the same time the register is pre-set from the detection of reference marks by scanning devices associated with respective printing stations.

Advantageously, the register and other pre-setting requirements are controlled by a microprocessor or the like, which is connected to the individual scanning devices and transducers via a multiplexer.

According to one aspect of the invention, a method and apparatus are provided for measuring the angular offset between predetermined locations on printing cylinders of a printing machine in which sheet or web material is moved past the cylinders. In accordance with this aspect, a first cylinder is rotated to cause printing of a first reference mark on the moving material from a predetermined location on the first cylinder while a second upstream cylinder is stationary. The first reference mark is detected at a location downstream of the first cylinder. Upon detecting the first reference mark, the relative angular position of the predetermined location of the first cylinder is determined and rotation of the first cylinder is stopped. Thereupon the second cylinder is rotated to cause printing of a second reference mark on the moving material from a predetermined location on the second cylinder while the first cylinder is stationary. Rotation of the predetermined location of the second cylinder past an angular position thereof corresponding to said relative angular position of the predetermined location of the first cylinder is detected. The second reference mark is then detected at the downstream location and the length of material which moves past the downstream location from the detection of the time at which the predetermined location of the second cylinder rotates past an angular position thereof corresponding to the relative angular position of the predetermined location of the first cylinder to the detection of the second reference mark is determined, this length being proportional to the angular offset between the predetermined locations on the first and second cylinders. A first pulse is generated upon the detection of each first reference when the first cylinder is rotating and is repeated when the first cylinder is stationary and the predetermined location of the second cylinder rotates past an angular position corresponding to that of the first cylinder. A second pulse is generated upon the detection of each second reference mark when the second cylinder is rotating. Additional pulses are generated in proportion to the length of material moved past the cylinders and the number of said additional pulses generated between a repeated first pulse and the next second pulse is counted, the number of additional pulses counted being proportional to the angular offset when the second reference mark is detected.

The web travel distance between the detection of two reference marks of the same printing station by a scanning device is measured; from this, the printing format or the cylinder circumference can be determined. The web travel distance between the detection of a reference mark at the scanning devices of two printing stations is measured; from this, the web travel distance between the two printing stations can be determined.

In accordance with another aspect of the invention, means are provided for measuring the angular offset between printing cylinders of a printing machine and for pre-setting the register in the printing machine which includes a plurality of printing stations each having at least one printing cylinder. Means are provided on each of the cylinders of an upstream and a downstream printing station for printing a reference mark on web or sheet material moved past the cylinders. At least one optical scanning device is disposed downstream of the printing cylinder of the downstream station for detecting the reference marks and providing respective signals in response thereto. Also provided are a first transducer which has an output proportional to the length of web moved past the transducer and at least one second transducer which has an output proportional to the angular rotation of a respective cylinder. Additional means are coupled to the first transducer, the optical scanning device and the second transducer and in response to the first transducer output, the optical scanning device signals and the second transducer output, a signal is provided proportional to the web distance between a signal corresponding to the angular position of the printing cylinder of the downstream printing station and the next occurring adjusting mark of the printing cylinder of the upstream printing station.

In a disclosed embodiment, the optical scanning device provides a pulse upon detection of each reference mark, the first transducer provides pulses in proportion to web length, and the second transducer provides pulses in proportion to cylinder angular rotation. The additional means is a first counter coupled to the first transducer and the optical scanning device and operative to count pulses from the first transducer corresponding to the angular position of the printing cylinders and to emit a signal corresponding to the relative angular position of the respective cylinder when the adjusting mark printed by that cylinder is detected. Further, the first counter emits a cylinder position signal whenever a number of pulses is counted which corresponds to the relative angular position of a stationary cylinder. A second counter is coupled to the second transducer to receive the pulses therefrom and to the optical scanning device, and is further coupled to the first counter to receive the angular position signals and the cylinder position signal therefrom and provide an output which corresponds to the angular offset of the two cylinders upon receiving the next pulse from the optical scanning device after the cylinder position pulse is secured.

In accordance with another aspect of the invention, adjusting means are provided for adjusting the angular position of a cylinder and wherein the output of the additional means is fed to the adjusting means as a positioning command.

In a disclosed embodiment, a multiplexer is coupled to the first transducer, the second transducer and the optical scanning device; and computer means are coupled to the multiplexer for receiving said pulses from the first and said second transducers and from the optical scanning device and providing the signal proportional to the web distance.

The printing machine also comprises a control console coupled to the computer means and a central control unit for receiving input and output data for and from the printing stations. Etchings are provided on at least one of the printing cylinders and the central control unit is operative to receive: the number of etchings per cylinder; the position of reference marks relative to a cutting register; and the position of sheet work reference marks relative to a perfecting adjusting mark; and provide output data for the automatic adjustment of the cutting and reversing register. The computer means can also provide a signal corresponding to the printing format in response to successive pulses corresponding to the same printing cylinder from the optical scanning device. The computer means can further provide a signal corresponding to the circumference of a printing cylinder in response to successive pulses from the optical scanning device corresponding to that printing cylinder. The computer means can also provide a signal proportional to the web travel distance between two printing stations from pulses from scanning devices associated with the two printing stations corresponding to successive detection of the same adjusting mark.

These and other aspects of the invention will be more apparent from the following description of the preferred embodiments of the invention taken in conjunction with the accompanying drawings and appended claims.

BRIEF DESCRIPTION OF THE DRAWINGS

The present invention is illustrated by way of example and not limitation in the figures of the accompanying drawings in which like references indicate similar parts and in which.

Figure 1:
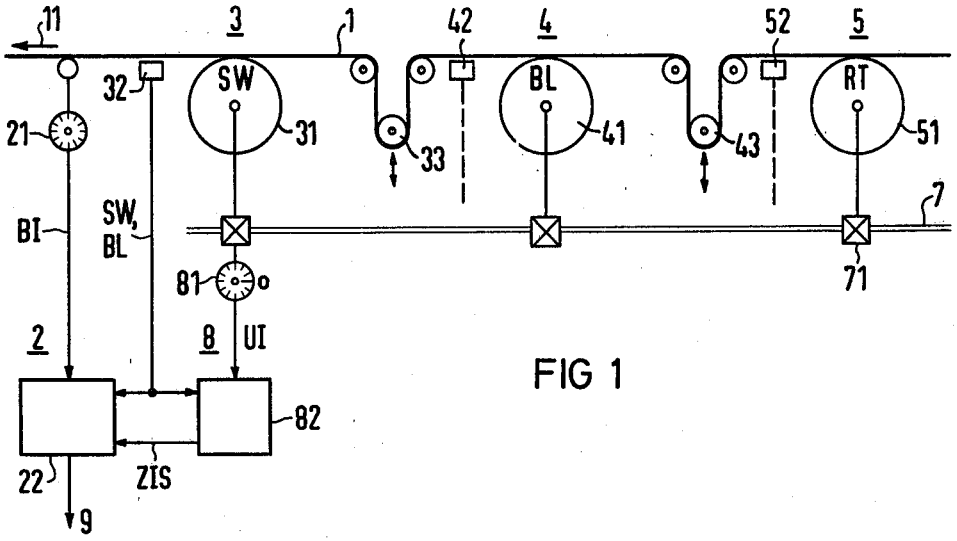
FIG. 1 is a block diagram depicting in somewhat schematic form a portion of a photogravure printing machine.
Figure 4:
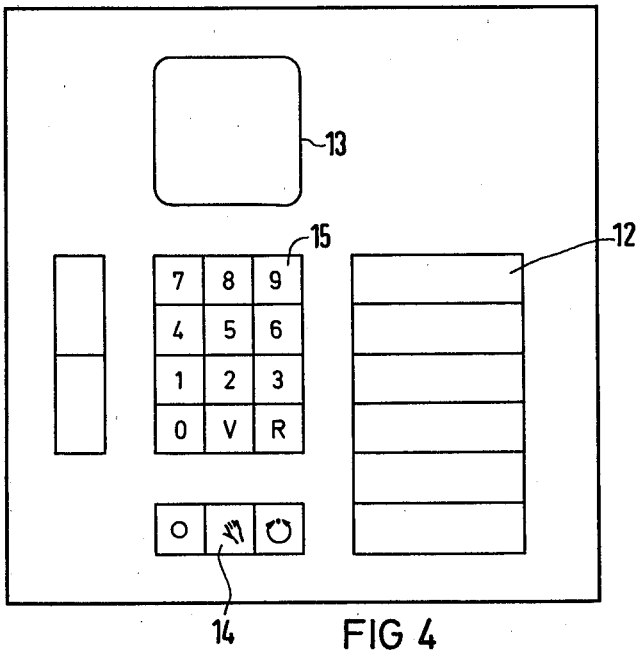
Figure 3:
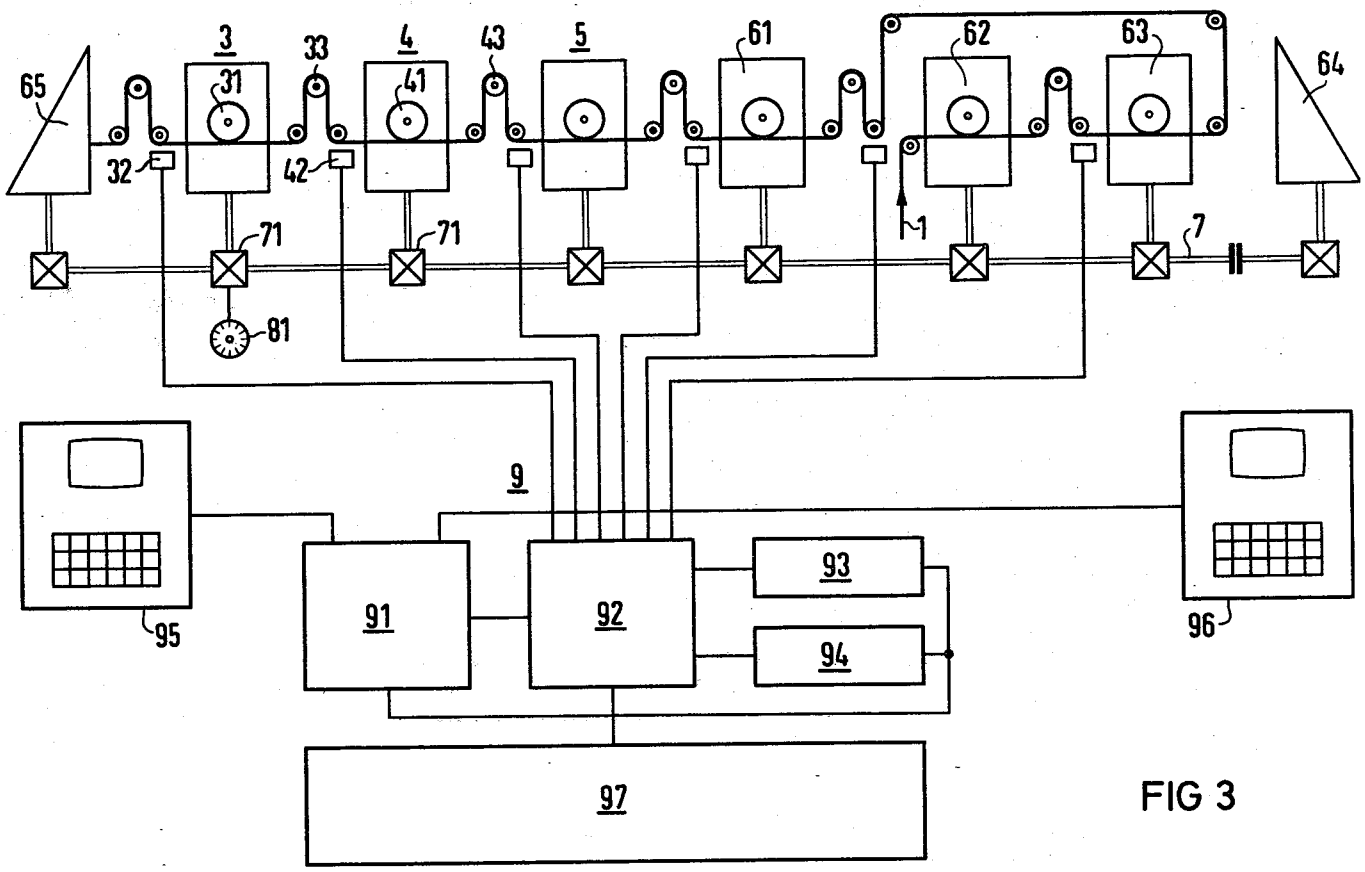

FIGS. *2a–2f* are timing diagrams depicting various waveforms emitted by elements of the printing machine of FIG. 1;

FIG. 3 is a more detailed block diagram depicting in somewhat schematic form a photogravure printing machine; and FIG. 4 is a front view in schematic of a control unit at an operating console of the machine of FIG. 3.

DESCRIPTION OF THE PREFERRED EMBODIMENTS

Referring to FIG. 1, the paper web 1 to be printed is guided first through a printing station 5 for printing red (RT) color, then through the printing station 4 for printing blue (BL) color, and then through the printing station 3 for printing black (SW) color. Printing cylinders 31, 41 and 51 are provided in each of the printing stations 3, 4, 5. Each of the printing cylinders has means thereon at a predetermined location thereof for printing reference or adjusting marks on the paper web 1. With each printing station are further associated optical scanning devices 32, 42 and 52, by which the adjusting marks printed on the web can be detected.

The individual printing cylinders 31, 41 and 51 are mechanically driven by a longitudinal shaft 7 and transmissions 71. It is pointed out, however, that the invention can be practiced equally well with printing machines without a longitudinal shaft.

Interposed between printing stations are registration control devices 33, 43, for example, in the form of control rolls. Adjustment of the control devices rotates the cylinders into a desired angular position and sets a predetermined web distance between adjacent cylinders. For a printing machine without a longitudinal shaft, the cylinder position is adjusted by means of the angle control of individual printing cylinders.

Pulse transmitter 81, which is coupled to the longitudinal shaft 7, generates a predetermined number of pulses UI per revolution of each cylinder which are fed to a counter 82. Counter 82 may alternatively take the form of a flip-flop which can provide an output pulse in response to clock pulses (UI) and a level pulse (SW, BL). Thus, the angular position of each of the individual printing cylinders can be accurately determined. For a printing machine without a longitudinal shaft, a pulse transmitter is coupled to each cylinder. Further provided is a web travel distance transmitter 21 which emits a number of pulses proportional to the web travel distance. The web travel distance transmitter 21 is normally part of the mark detection system for the scanning devices 32, 42 etc. Pulses BI which are emitted by the travel distance transmitter 21 and in proportion to a given web length, are fed to a counting device 22, the counting state of which is controlled by the scanning device 32 and the counter 82.

Figures 2A, 2B, 2C, 2D, 2E, 2F:
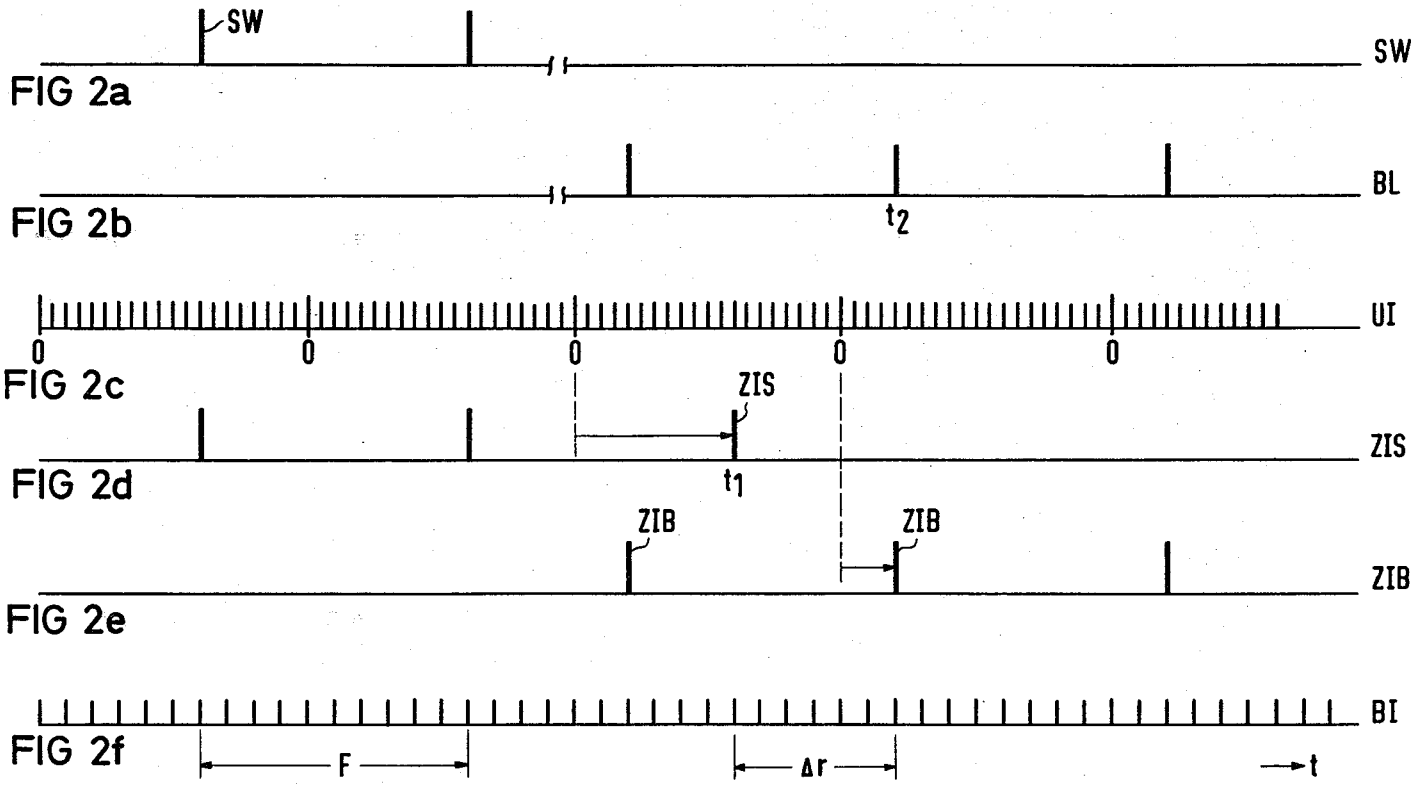

The register is pre-set according to the invention as follows. With reference to FIGS. 1 and 2, first, the printing station 3 is operated by rotating printing cylinder 31. The scanning device 32 detects the black (SW) adjusting marks printed on the web by cylinder 31 and emits pulses (SW) which are shown in FIG. 2*a*. When an SW pulse appears, the corresponding count in the counter 82 of the cylinder angular rotation pulses (UI) is stored. This value corresponds to the geometrical position of the black adjusting mark detected relative to the printing cylinder circumference in the counter 82. Each time that this stored value of pulses UI (FIG. 2*c*) is counted in the counter 82, counter 82 emits a cylinder pulse ZIS, which is fed to counter 22. The count stored in counter 22 can be used to provide a defined reading of the counter 82 at the time a cylinder pulse ZIS (FIG. 2*d*) is emitted by counter 82. The cylinder pulse can optionally also be utilized in the control system for enabling the scanning device.

After the cylinder pulse ZIS is generated, the black (SW) printing station 3 is switched off and the blue (BL) printing station 4 is switched on. After some time, the blue adjusting marks (BL) printed on the web by the blue cylinder 41 will be detected by the scanning device 32 and pulses designated BL in FIG. 2*b* are generated. If the counter 22 for the web pulses BI (FIG. 2*f*) of the pulse transmitter 21 is enabled by a cylinder pulse ZIS of the black printing station 3, for instance, at time $t_1$ (FIG. 2*d*) and is disabled when the blue adjusting mark BL appears at the scanning device 32 at time $t_2$ (FIG. 2*b*), then the counter reading of the web pulses BI (FIG. 2*f*) is proportional to the registration error $\Delta$ r. This value can then be used to correspondingly control the positioning device 33 as indicated by arrow 9 (FIG. 1) for providing registration. For printing presses without a longitudinal shaft, this value would be passed-on as an angular shaft value to the angle controllers of the individual drives.

After this adjusting process for stations 3 and 4 is completed, the same process is repeated with respect to printing stations 4 and 5. First, a blue adjusting mark is now made by the blue printing cylinder 41 with the red printing cylinder 51 switched off and the count in counter 82 is stored. Thereafter, the blue printing cylinder at printing station 4 is switched off, the red printing cylinder is switched on at the red printing station, a cylinder pulse ZIB is emitted each time the count in counter 82 is equal to the stored count, the red printing mark is detected and a ZIR pulse (not shown) is generated. The measurement is repeated as above in which the registration error of web pulse BI is the counter reading between the ZIB and ZIR pulses. The same procedure can be carried out for further printing stations, not shown.

In addition, it is also possible to determine the cutting registration and the sheet work registration as well as the format or the cylinder circumference for the control system. This is accomplished by measuring the web travel distance by means of the counter 22 between two successive black adjusting marks, after the printing at the black printng station has been started.

Similarly, it is also possible to determine, for the control system and a waste follow-up system, the web travel distance between the two printing stations, for instance, 3 and 4, by switching off the printing cylinder at the black printing station and switching on the cylinder at the blue printing station. With the scanning device 42 at the blue printing station, the adjusting mark BL is then detected and the web travel distance is measured with the counting device 22 until the blue adjusting mark is detected by the scanning device 32 of the black printing station 3.

The measurements described above can be made in parallel, i.e., simultaneously for first-form and sheet work printing. All the measurements which have been described above successively are advantageously made generally simultaneously for time-saving reasons.

In FIG. 3 a somewhat more detailed printing machine including a control system is illustrated. The printing machine includes printing stations, for example, 61, 62 and 63, which follow the printing station 5 of FIG. 1. Folding deices 64 and 65 are provided at both ends of the printing machine.

The web 1 is first conducted through the printing stations 62 and 63, then passes through a reversing stage in order that printing can be carried out on both sides of the web. The web next travels through printing stations 61, 5, 4, and 3 to the folding device 65. The folding device 64 is not in operation when the web is moved to the left in FIG. 3 towards folding device 65. The individual printing stations and folding devices can be traversed or arranged in other sequences as desired.

The signals generated by the scanning devices 32, 42, the pulse transmitters 21 etc. and the angle transducer 81 are processed in a digital control 9. Control 9 comprises a microcomputer 91, which receives via a multiplexer 92 the individual measurement values and processes them. Display and control of the individual processes can be carried out selectably from two consoles 95 or 96. In the control 9 are further provided a mark identification device 93 and a registration control 94, preferably analog, which also operate via the multiplexer 92. The positioning commands for the printing machine are sent to the machine control 97.

Before production starts, the machine occupation and production data must be entered into the control. Thus, the number of etchings of the cylinders and the position of the adjusting mark relative to the cut are entered. From this, the control can then set the step registration. The same applies similarly to the sheet work registration (reversal register), for which the position of the sheet work adjusting mark to the perfecting adjusting mark must be entered.

If also the pulling-out schedule is known, this can be entered with the other production data and serves to control the folding device.

The control is advantageously further designed so that the data of all printing marks can be entered, read out and, if necessary, corrected with a single control unit at the console. Advantageously, the console is then located near the sheet delivery.

FIG. 4 depicts the control unit at the operation console. The control unit includes a function keyboard 12, by which, for example, the control point, etching imperfections, cut/reversing register, etc., can be selected, a digital input 15, a data display screen 13 and a mode-of-operation selector switch 14 (for example, for automatic or manual operation).

The etching operations and apparatus, the cut/reversing operations and apparatus, the format operations and apparatus, the step registration operations and apparatus, the cutting operations and apparatus, and the sheetwork registration (reversal register) operations an apparatus are otherwise conventional and are not described herein.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of the disclosure without departing from the spirit and scope of the invention.

What is claimed is:

1. A method of measuring the angular offset between predetermined locations on printing cylinders of a printing machine in which sheet or web material is moved past the cylinders, comprising the steps of causing a first cylinder to print a first reference mark on the moving material from a predetermined location on the first cylinder while a second upstream cylinder is not printing, detecting the first reference mark at a location downstream of the first cylinder, upon detecting the first reference mark, determining the relative angular position of the predetermined location of the first printing cylinder, thereafter causing the second cylinder to print a second reference mark on the moving material from a predetermined location on the second cylinder while the first cylinder is not printing, detecting the times at which the predetermined location of the second cylinder rotates past an angular position corresponding to the relative angular position of the predetermined location of the first cylinder when the first reference mark was detected, detecting the second reference mark at said downstream location, and determining the length of material which moves past said downstream location between the detection of one of said times and the detection of the next second reference mark, said length being proportional to the angular offset between the predetermined locations on the first and second cylinders.

2. The method according to claim 1 and comprising the steps of generating a first pulse when each of said times is detected, generating a second pulse upon the detection of the second reference mark, generating additional pulses in proportion to the length of material moved past said downstream location and counting the number of said additional pulses generated between adjacent first and second pulses, the number of additional pulses counted between adjacent first and second pulses being proportional to said angular offset.

3. The method according to claim 2 wherein a drive for the first and second cylinders includes a common rotating element whose angular rotation is proportional to the angular rotation of the cylinders, said method including the steps of generating a number of cylinder position pulses in proportion to the angle of rotation of said common element from a reference point, determining the cylinder position pulse generated when said first reference mark is detected, and generating said first pulse when said cylinder position pulse is thereafter generated.

4. A method for pre-setting registration in a printing machine comprising measuring the angular offset between predetermined locations on printing cylinders according to claim 1 and generating a signal proportional to said length of material and utilizing this signal as a positioning command to adjust the angular position of a respective printing cylinder.

5. The method according to claim 4 and utilizing the length of material which passes the downstream location between the detection of two reference marks of the same printing cylinder for determining the printing format.

6. The method according to claim 4 and utilizing the length of material which passes the downstream location between the detection of two reference marks of the same printing cylinder for determining the cylinder circumference.

7. The method according to claim 4 and utilizing the length of material which passes the downstream location between the detection of a reference mark at a location upstream of the first printing cylinder and the detection of the same reference mark at the downstream location for determining the material travel distance between the two printing stations.

8. In a printing machine including a plurality of printing stations each having at least one printing cylinder which can be activated for printing independently of printing cylinders of other stations, means for determining the angular offset of the printing cylinders of an upstream and a downstream printing station comprising means disposed at a predetermined location on each of the cylinders of the upstream and downstream printing stations for printing a reference mark on web or sheet material moved past the cylinders, optical scanning means disposed downstream of the printing cylinder of the downstream station for detecting reference marks printed by the two cylinders and providing respective output signals in response thereto, first transducer means having an output signal proportional to the length of material moved past the first transducer means, second transducer means having an output signal proportional to the angular rotation of a respective cylinder, first means coupled to receive the output signals of the scanning means and the second transducer means and in response thereto determining the relative angular position of the predetermined location of the downstream printing cylinder when a reference mark printed by the downstream printing cylinder is detected and for providing an output signal each time the predetermined location of the upstream printing cylinder rotates past an angular position corresponding to the relative angular position of the predetermined location of the downstream printing cylinder when the reference mark printed by the downstream printing cylinder was detected and second means coupled to receive the output signals of the first transducer means, the scanning means and the first means and providing a signal proportional to the distance travelled by the material between an output signal of the first means when the printing cylinder of the downstream printing station is not printing and when the printing cylinder of the upstream printing station is printing and the next reference mark printed by the printing cylinder of the upstream printing station detected by the optical scanning means.

9. The apparatus according to claim 8, wherein the optical scanning means provides a pulse upon detection of such reference mark, the first transducer means provides pulses in proportion to the length of material which moves therepast, and the second transducer means provides pulses in proportion to cylinder angular rotation, the first means comprising a first counter coupled to the second transducer means and the optical scanning means operative to count pulses from the second transducer means, to store a pulse count upon receipt of a selected pulse from the optical scanning means, and to provide an output pulse whenever the pulse count equals the stored count, the second means comprising a second counter coupled to the first transducer means to receive the pulses therefrom and further coupled to the optical scanning means to receive the pulses therefrom and to the first counter to receive the output pulse therefrom, and in response thereto, provide an output proportional to the number of pulses received from the first transducer means between said output pulse from said first counter and a selected pulse from the optical scanning means.

10. Means for pre-setting the registration of printing cylinders in the apparatus according to claim 9 comprising adjusting means for adjusting the angular position of a cylinder wherein the output of said second counter is coupled to said adjusting means as a positioning command.

11. The apparatus according to claim 8 wherein said first and second means comprise a computer.

12. Means for pre-setting the registration of printing cylinders in the apparatus according to claim 8 comprising adjusting means for adjusting the angular position of a cylinder wherein the output of said second means is coupled to said adjusting means as a positioning command.

13. The apparatus according to claim 12 wherein said first and second means comprise a computer.

* * * * *